US005585581A

United States Patent [19]

Rogers

[11] Patent Number: 5,585,581

[45] Date of Patent: Dec. 17, 1996

[54] GEL DRUMHEAD TRANSDUCING

[75] Inventor: Thomas P. Rogers, Englewood, N.J.

[73] Assignee: RTOM Corporation, Englewood, N.J.

[21] Appl. No.: 584,316

[22] Filed: Jan. 16, 1996

Related U.S. Application Data

[63] Continuation-in-part of Ser. No. 902,715, Jun. 23, 1992.

[51] Int. Cl.[6] ..... G10D 13/02

[52] U.S. Cl. ..... 84/414; 84/723

[58] Field of Search ..... 84/414, 723, 730, 84/743

[56] References Cited

U.S. PATENT DOCUMENTS

| | | | |
|---|---|---|---|
| 4,282,793 | 8/1981 | Muchnick | 84/414 |
| 5,385,076 | 1/1995 | Belli | 84/414 |
| 5,430,245 | 7/1995 | Rogers | 84/725 |

*Primary Examiner*—Patrick J. Stanzione
*Attorney, Agent, or Firm*—Fish & Richardson P.C.

[57] ABSTRACT

There is a gel drumhead mechanically coupled to an mechanoelectrical transducer. The gel drumhead is constructed and arranged to present substantially the same resistive forces to drum sticks when struck presented by an acoustic drum correspondingly struck.

8 Claims, 7 Drawing Sheets

GEL DRUMHEAD TRANSDUCING

This application is a continuation-in-part of application Ser. No. 07/902,715, filed Jun. 23, 1992, of Thomas P. Rogers entitled PERCUSSION INSTRUMENT DAMPING incorporated by reference herein.

The present invention relates in general to drumhead transducing and more particularly concerns gel drumhead transducing.

This invention represents an improvement over the invention disclosed in U.S. Pat. No. 5,430,245 granted Jul. 4, 1995, entitled ELECTROACOUSTICAL DRUM incorporated by reference herein.

It is an important object of the invention to provide improved drumhead transducing.

According to the invention, the drumhead has an energy absorbing gel material as a playing surface coupled to a mechanoelectrical transducer.

Other features, objects and advantages of the invention will become apparent from the following description when read in connection with the accompanying drawings in which.

Figure 1A:
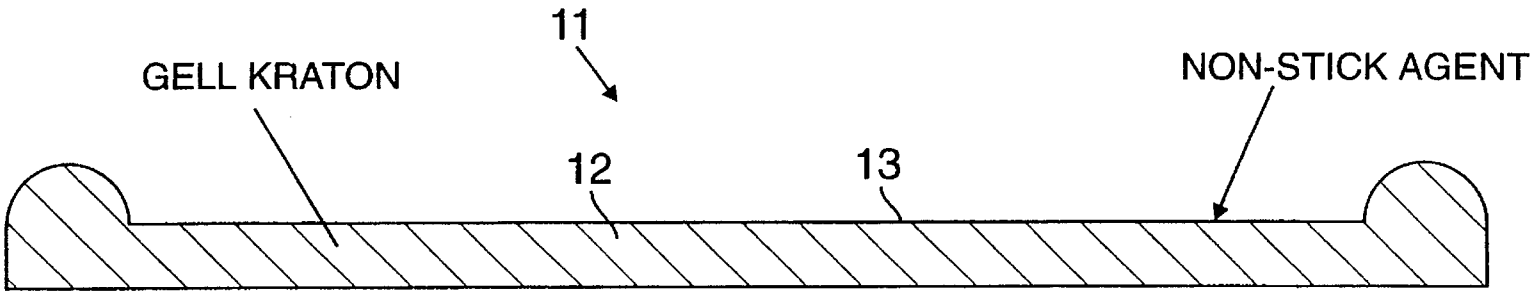
FIG. 1A is a diametrical sectional view through a gel drumhead according to the invention.

With reference now to the drawings and more particularly FIG. 1A thereof, there is shown a diagrammatical sectional view of an exemplary drumhead 11 of Kraton gel 12 enclosed in a nonstick agent 13, such as wax. A gel is a two-phase colloidal system consisting of a solid and a liquid in more solid form than a sol, a sol being a colloidal solution consisting of a suitable dispersion medium, which may be gas, liquid, or solid and the colloidal substance, the disperse phase, which is distributed throughout the dispersion medium. The gel 12 typically comprises a base material, such as Kraton, polyurethane, PVC (polyvinyl chloride) and silicon. The gel 12 may have a durometer range of 5 shore-00 to 80 shore-00. The 00 scale is a standard scale for measuring some foams and very soft substrates.

The Kraton gel 12 is a styrene, oil and rubber based gel commercially available from Shell Oil Company sold under the trademark Kraton.

Figure 1B:
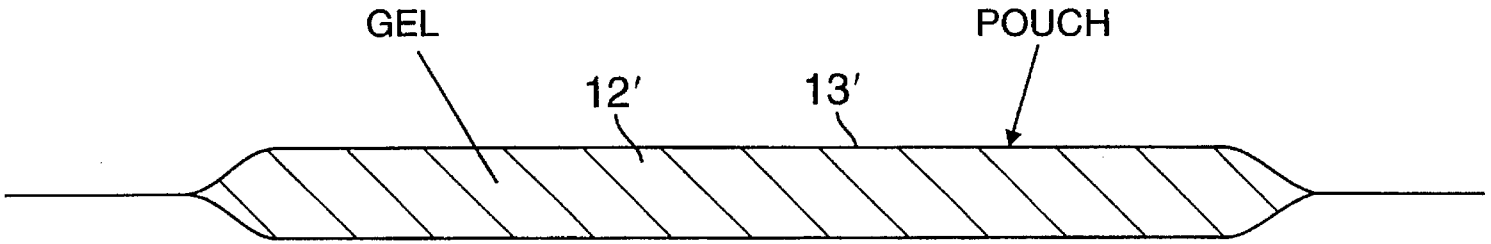
FIG. 1B is a diametrical sectional view through a gel drumhead according to the invention having the gel encapsulated in a pouch.

Referring to FIG. 1B, there is shown a diametrical sectional view of a drumhead 11' with a gel 12' encapsulated in a pouch 13' typically made of urethane. Gel 12' maybe PVC, polyurethane or silicone. The polyurethane pouch 13' is typically 60 durometer shore-A which provides a nonstick barrier for shore 00 compounds of polyurethane, PVC and silicone. The Kraton gel 12 is especially advantageous for drumheads because it may be pelletized and injection-molded. For a bass drum pad (FIGS. 8A and 8B) polyurethane gel has been advantageously used. The shore 00 durometers selected for the gel is preferably related to the acoustical drum being simulated by a gel-headed electronic drum according to the invention. It is preferred that the give or throw of the gel drumhead and the restoring force that returns the gel drumhead surface to its rest position correspond to that of the acoustic drum being simulated. The gel drumhead is preferably thick enough to absorb enough energy from the stick, mallet or beater before the average drummer will exceed the damping properties of the gel which would occur when the gel compresses at the point of impact to where the top surface is substantially in contact with the bottom surface of the gel and is preferably at least 0.250 inch thick.

Figure 2:
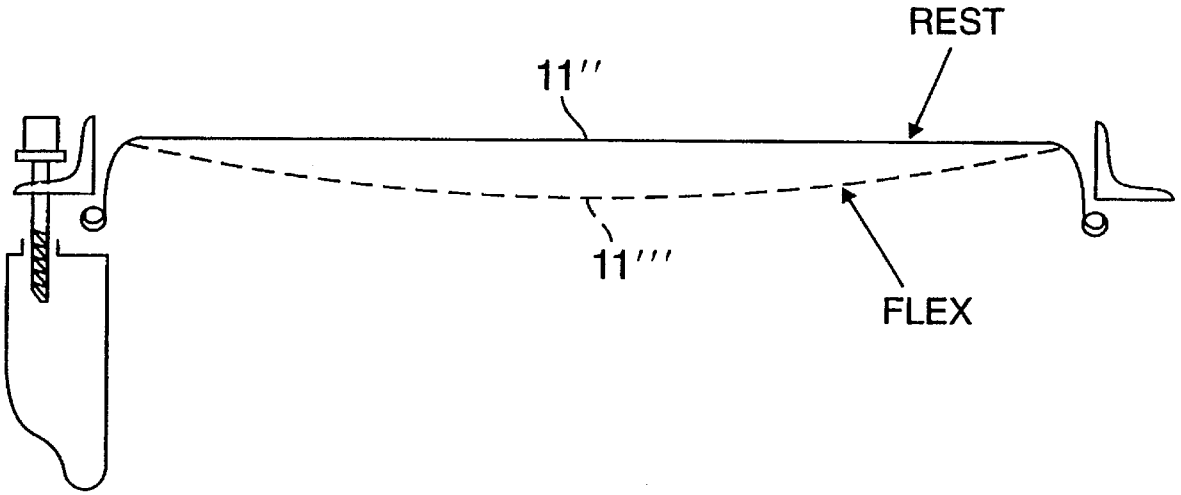
FIG. 2 is a diagrammatical diametrical sectional view of a conventional drumhead illustrating a typical range of deflection when struck.

Referring to FIG. 2, there is shown a diagrammatic representation of conventional drumhead 11" in its rest position and in the flex position 11'" after being struck.

It has been discovered that Kraton gel with its rubber, oil and styrene base with a high molecular weight provides a low durometer typically 50 shore 00 and spring constant substantially equal to that of an acoustic snare drum.

Figure 3:
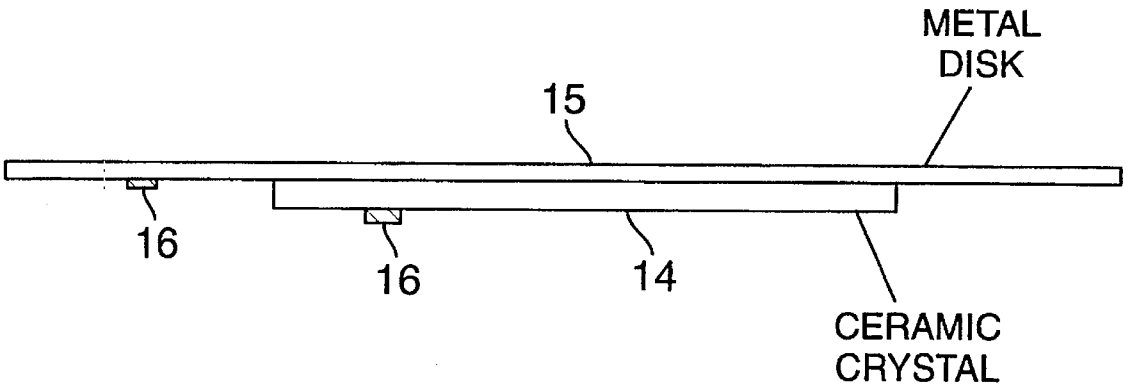
FIG. 3 is a diagrammatical representation of a suitable piezoelectric transducer for attachment to the underside of the gel pad drumhead.

Referring to FIG. 3, there is shown a diagrammatic elevation view of a piezoelectric transducer structure including a ceramic crystal 14 attached to a metal disc 15 that furnishes a transduced signal between leads 16. The resonant characteristics of the device are related to the diameter and thickness of disc 15. The voltage output is proportional to the thickness of the ceramic crystal 14 and the magnitude of the force applied to the assembly. The assembly used in the invention preferably has a resonant frequency below 1500 Hz.

Figure 4:
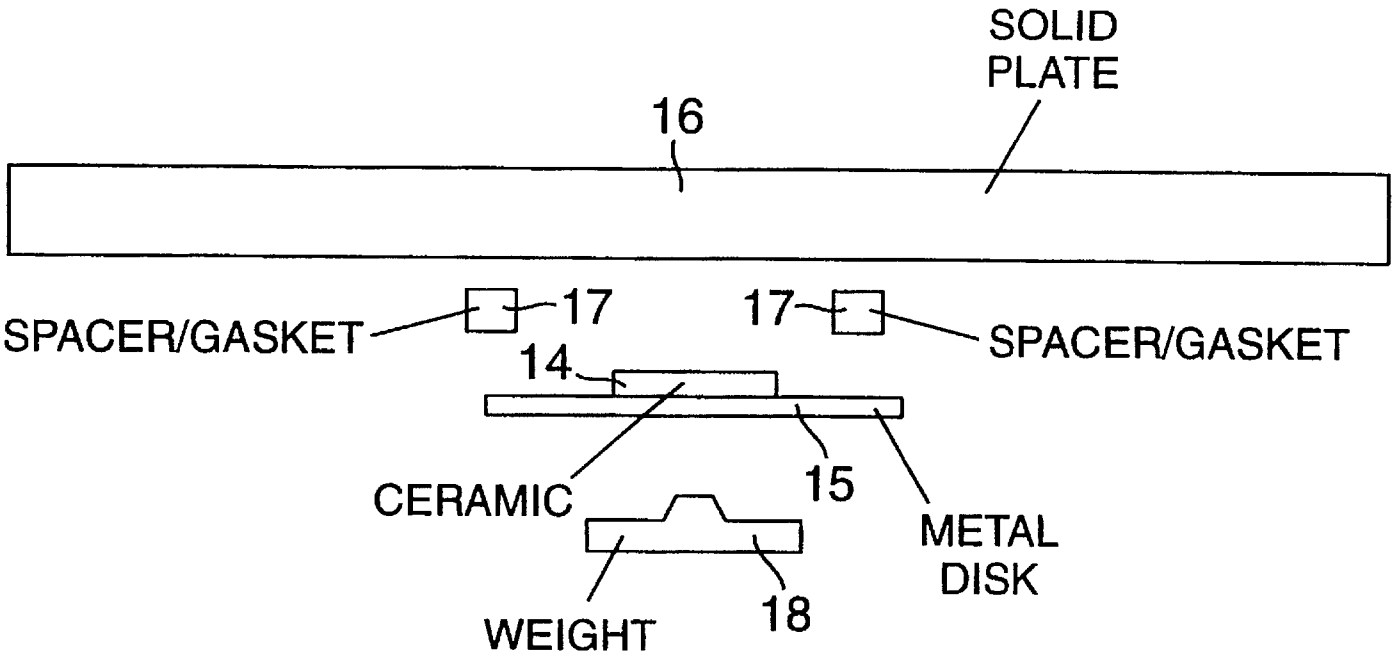
FIG. 4 is an exploded view of a piezoelectric transducer assembly suitable for use in the invention.

Referring to FIG. 4, there is shown an exploded diagrammatic representation in elevation of a suitable piezoelectric assembly for use in the invention. Metal disc 15 is attached to a solid plate 16 by an annular spacer gasket 17 and carries a weight 18 attached to the center of disc 15.

Figure 5:
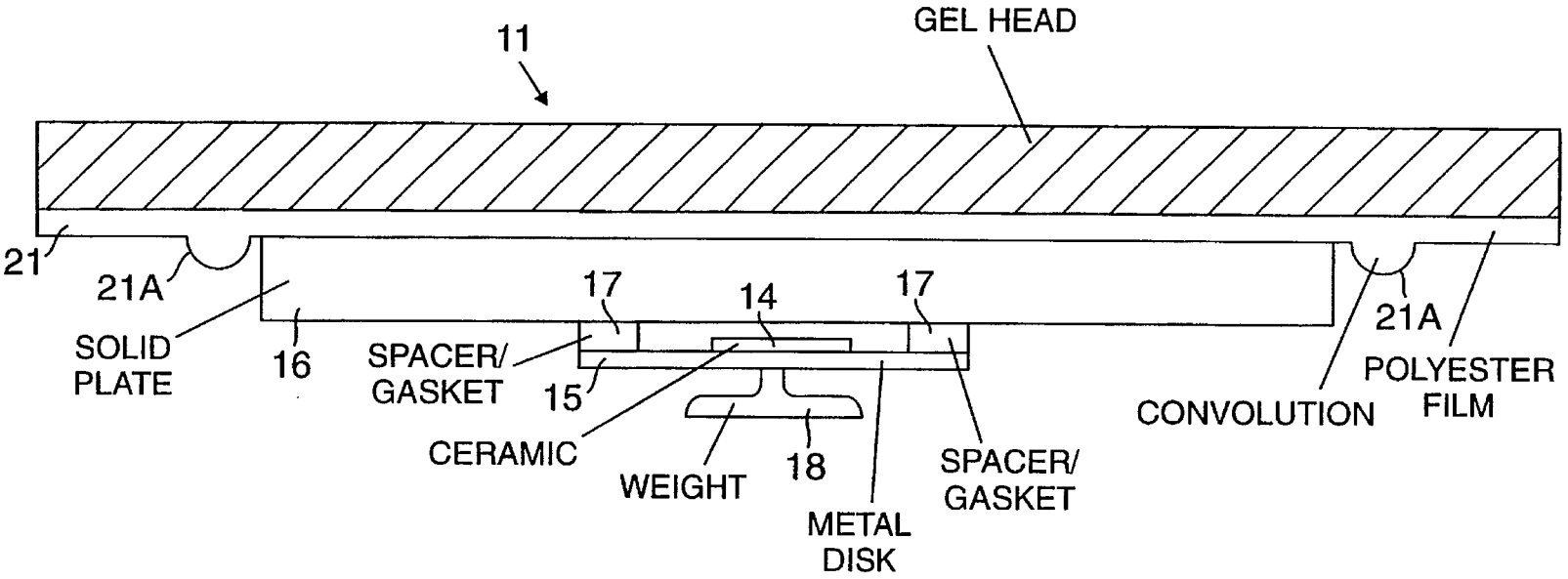
FIG. 5 is a diagrammatical diametrical sectional view showing the assembly of FIG. 4 mechanically coupled to the gel drumhead according to the invention.

Referring to FIG. 5, there is shown a diagrammatical representation in elevation of the assembly of FIG. 4 mechanically coupled to gel head 11 through a polyester film 21 attached to solid plate 16. Polyester film 21 is formed with an annular convolution 21A embracing solid plate 16.

Figure 6:
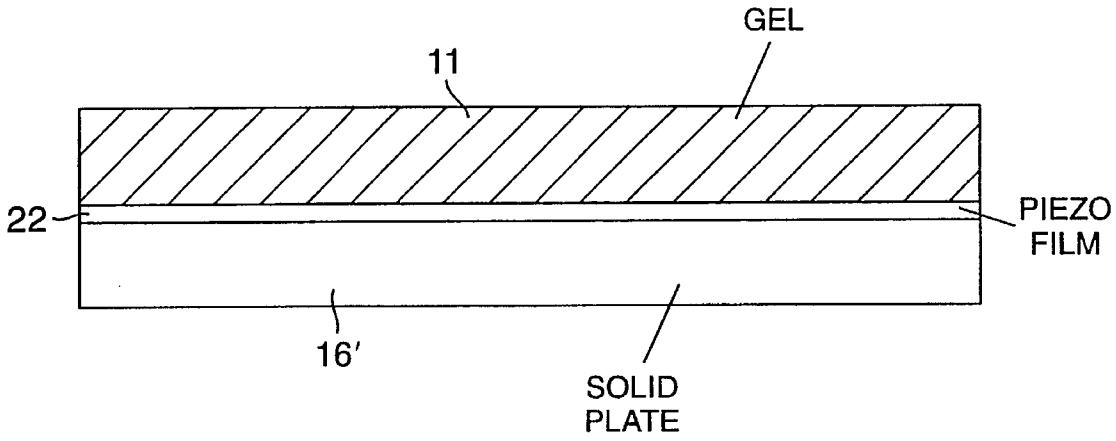
FIG. 6 is a diagrammatical diametrical sectional view of another embodiment using a piezoelectric film sandwiched between the gel drumhead and the solid plate.

Mechanically coupling the ceramic disc 14 to gel drumhead 11 has a number of advantages. The resonant frequency of the assembly is reduced to a value near that of the natural frequency of gel head 11 and the driving force frequency, both of which are typically below 100 Hz. Because the spring mass system of FIG. 6 is more a shock sensor than a strain sensor, the output signal is more nearly uniform with respect to the striking position on the gel drumhead surface; that is, edge-vs.-center. The spring mass resonant frequency is related to the thickness of gel head 11 and plate 16. Increasing thickness of plate 16 is preferably accompanied by an increase in the mass of the assembly suspended from spacer gasket 17 to increase sensitivity by correspondingly lowering the resonance of the assembly attached to plate 16. A resonance of 160 Hz has been found to be especially advantageous.

Polyester suspension film 21 helps provide a suspension system independent of the suspension of ceramic disc 14 and provides a barrier to outside vibration. Varying the thickness of polyester film 21 and the radius of convolution 21A affects the rebound of the stick striking gel head 11. As a result, a combination of the durometer of gel 12 and these properties of polyester film 21 allows achieving the throw and rebound of the various tunings of an acoustic drum being simulated.

Another low cost alternative for triggering a MIDI (musical instrument digital interface) drum machine uses an electromagnetic transducer that acts as a moving diaphragm like a piston with the suspension film and transducer suspension determining the resonance of the system. Such a system is show in FIG. 9.

Referring to FIG. 6, there is shown a diagrammatic representation in elevation of another embodiment of the invention having a piezoelectric film 22 sandwiched between the gel drumhead 11 and a solid plate 16'.

Figure 7:
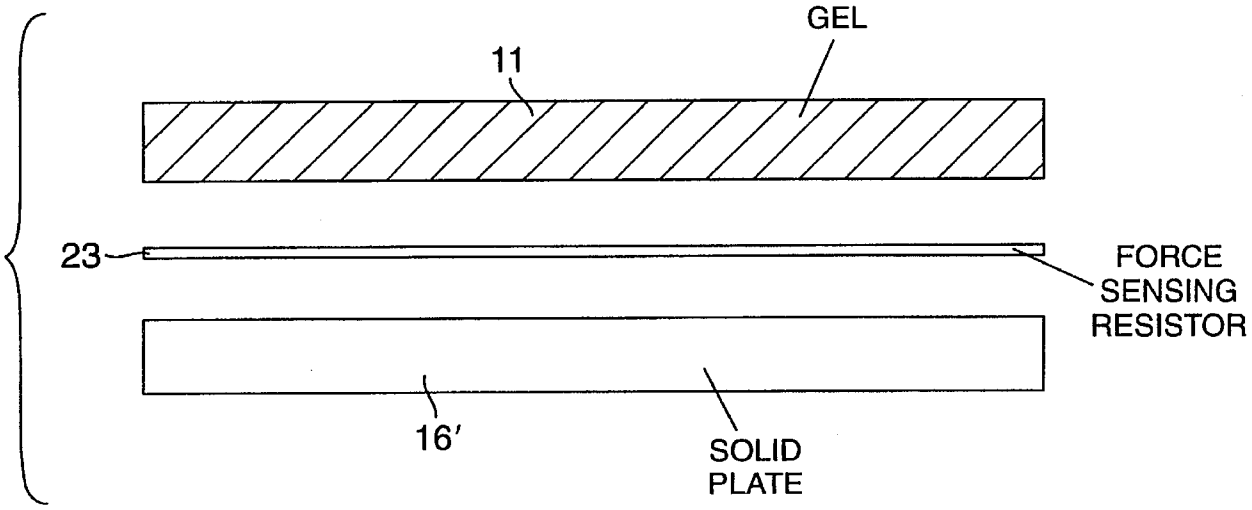
FIG. 7 is another alternative embodiment of the invention showing an exploded view of a force sensing resistor sandwiched between the gel drumhead and the solid plate.

Referring to FIG. 7, there is shown a diagrammatic exploded view in elevation of another embodiment of the invention with a force-sensing resistor 23 sandwiched between gel drumhead 11 and solid plate 16'.

Figure 8A:
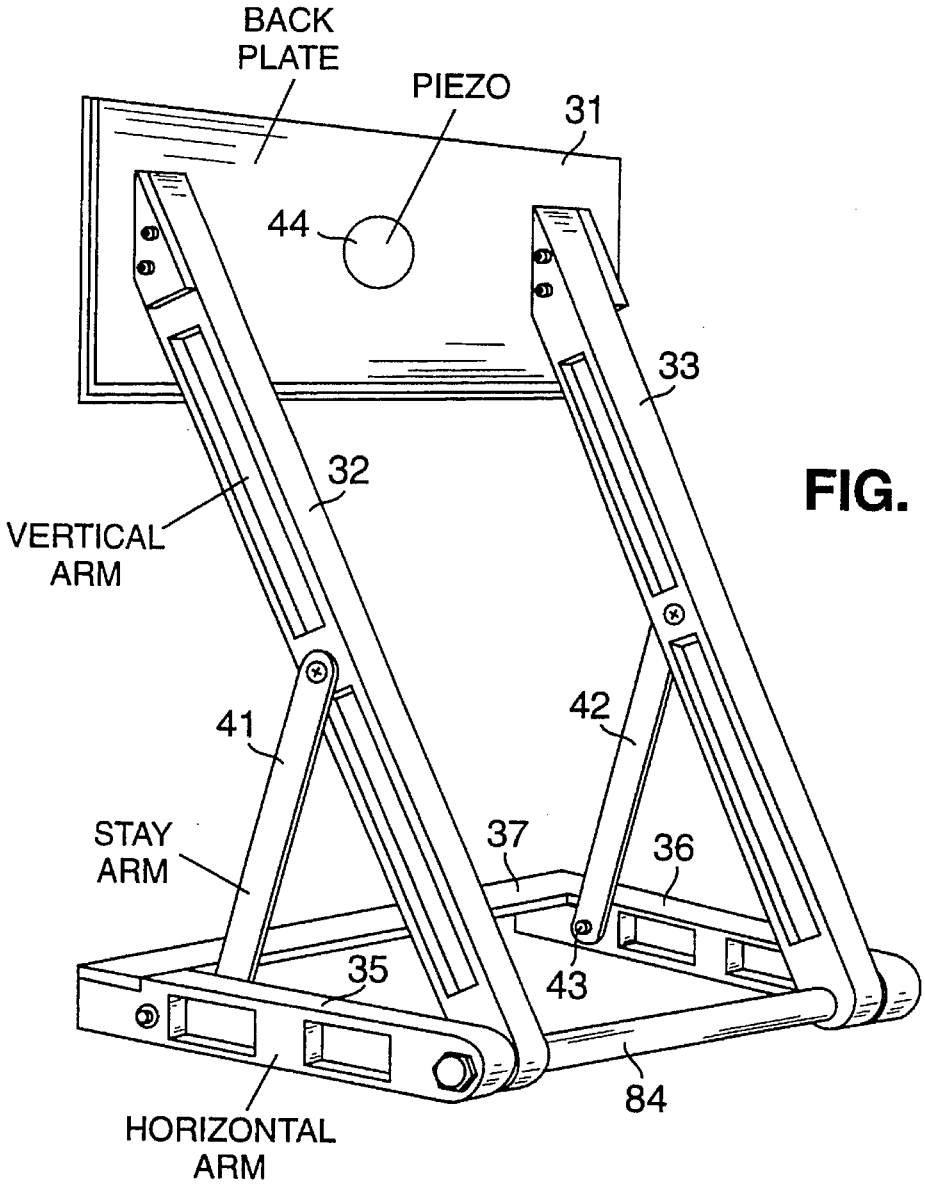
FIG. 8A is a perspective view of another embodiment of the invention suitable for use as an electronic bass drum.

Referring to FIG. 8A, there is shown a perspective view of an electronic bass drum comprising a back plate 31 attached to the top of vertical arms 32 and 33 pivotally attached at the bottom to an axle 34 supported in the rear ends of horizontal arms 35 and 36 attached at their front ends to front horizontal bar 37. Stay arms 41 and 42 are pivotally attached at their top to the middle of vertical arms 32 and 33, respectively and at their bottom ends to studs, such as 43 so that the unit can collapse downward for transport. Backplate 31 carries a piezoelectric transducer 44.

Figure 8B:
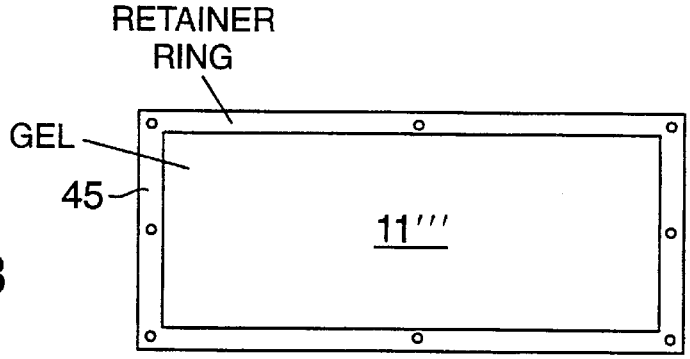
FIG. 8B is a front view of the back plate of FIG. 8A.

Referring to FIG. 8B, there is shown a front view of backplate 31 having gel 11" secured by retaining ring 45.

Figure 9:
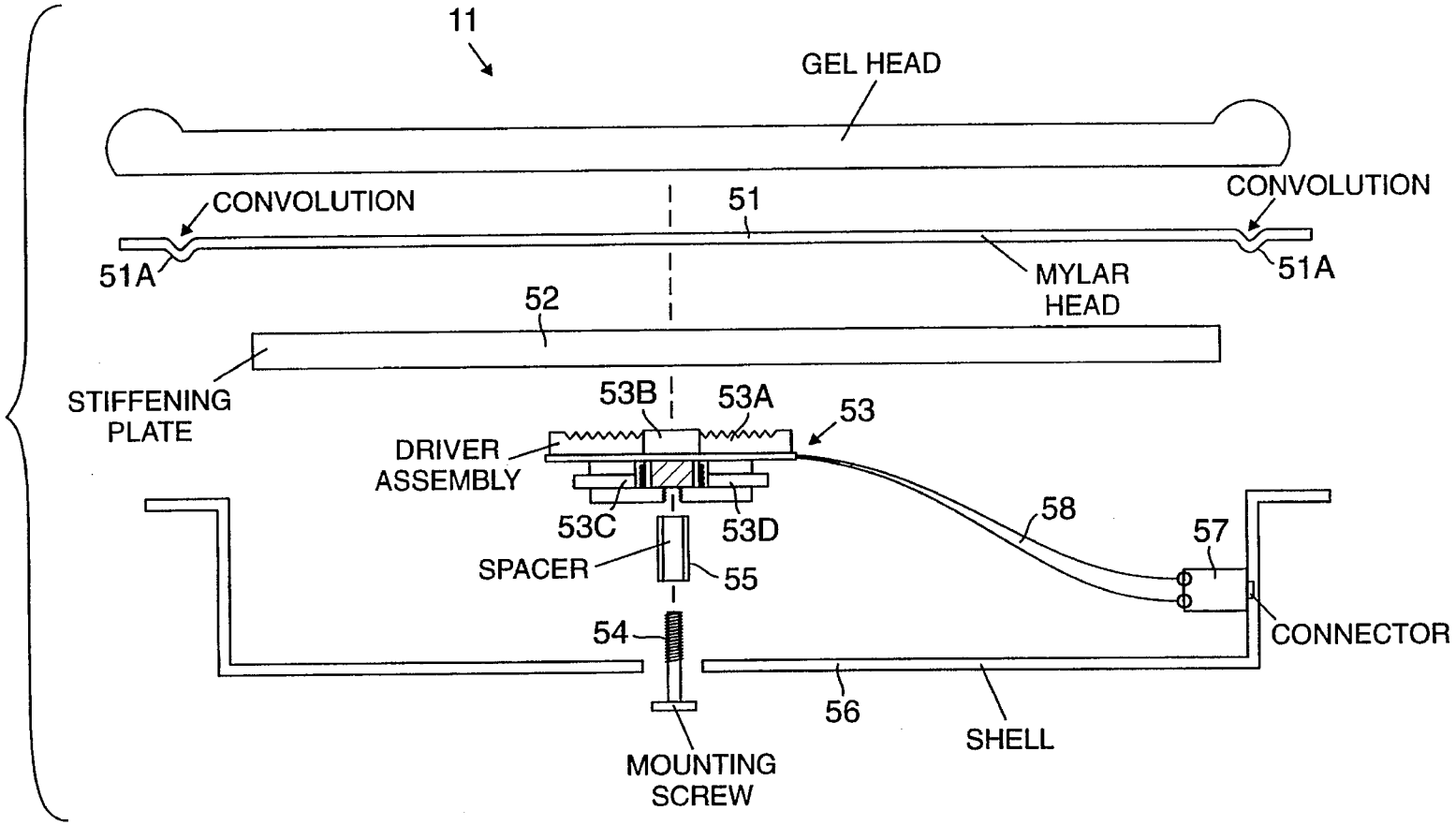
FIG. 9 is an exploded diagrammatic elevation view of another embodiment of the invention using a voice coil transducer.

Referring to FIG. 9, there is shown a diagrammatic exploded view in elevation of another embodiment of the invention using a loudspeaker transducing assembly. Gel head 11 is attached to mylar head 51 formed with an annular convolution 51A embracing a stiffening plate 52. Driver assembly 53 is attached to stiffening plate 52 and includes a spider 53A supporting a voice coil 53B free to move in the gap 53C of the permanent magnet structure 53D that creates a magnetic field in gap 53C. A mounting screw 54 passing through spacer 55 secures driver assembly 53 to shell 56 that carries a connector 57 connected by leads 58 to voice coil 53B.

The drumhead convolution 51A and spider 53A are preferably constructed and arranged so that a maximum of 70 milliseconds decay time is reached with no peaks greater than 50% of the original peak when observing the output signal furnished by connector 57 on an oscilloscope. The system resonant frequency is preferably above 50 Hz. Controlling the resonant frequency of the system helps avoid confusing the threshold of the input comparator of a MIDI computer by multiple oscillations caused by ringing of the mass-spring system. It is preferred that stiffening plate 52 have a flex modulus of at least 200,000 psi to achieve good transmission from gel drumhead 11 to the transducer. The system suspension is preferably tuned closer to a midrange loudspeaker, with the dimensions closer to those of a woofer, a typical diameter of gel drumhead 11 being 10 inches.

Other embodiments are within the claims.

What is claimed is:

1. Mechanoelectrical apparatus comprising, a gel drumhead, and an mechanoelectrical transducer mechanically coupled to said gel drumhead constructed and arranged to provide an electrical signal representative of forces applied to said drumhead, said gel drumhead constructed and arranged to present substantially the same resistive forces to drum sticks when struck presented by an acoustic drum correspondingly struck.

2. Mechanoelectrical apparatus in accordance with claim 1 wherein said mechanoelectrical transducer comprises a piezoelectric transducer.

3. Mechanoelectrical apparatus in accordance with claim 1 wherein said mechanoelectrical transducer comprises a loudspeaker driver assembly including a voice coil moveable in a magnetic field.

4. Mechanoelectrical transducing apparatus in accordance with claim 1 wherein said gel drumhead is made of a compound with a base material from the group consisting of (1) a styrene, oil and rubber-based material, (2) polyurethane (3) polyvinyl chloride and (4) silicone.

5. Mechanoelectrical transducing apparatus in accordance with claim 4 wherein the gel in said drumhead has a durometer range between 5 shore-00 and 80 shore-00.

6. Mechanoelectrical transducing apparatus in accordance with claim 1 wherein said gel drumhead is a gel coated with a nonstick barrier.

7. Mechanoelectrical transducing apparatus in accordance with claim 6 wherein said nonstick barrier is from the group consisting of wax and urethane.

8. Mechanoelectrical transducing apparatus in accordance with claim 7 wherein the nonstick barrier is a polyurethane film of durometer of the order of 60 shore.

* * * * *